US008894043B2

(12) United States Patent
Kellermann

(10) Patent No.: US 8,894,043 B2
(45) Date of Patent: Nov. 25, 2014

(54) ELECTRICALLY ACTIVATED CARBURETTOR

(75) Inventor: Christian Kellermann, Grande (DE)

(73) Assignee: Makita Corporation, Anjo-shi (JP)

( * ) Notice: Subject to any disclaimer, the term of this patent is extended or adjusted under 35 U.S.C. 154(b) by 367 days.

(21) Appl. No.: 13/321,931

(22) PCT Filed: May 27, 2010

(86) PCT No.: PCT/EP2010/003218

§ 371 (c)(1),
(2), (4) Date: Nov. 22, 2011

(87) PCT Pub. No.: WO2010/136199

PCT Pub. Date: Dec. 2, 2010

(65) Prior Publication Data

US 2012/0074600 A1 Mar. 29, 2012

(30) Foreign Application Priority Data

May 27, 2009 (DE) ..... 20 2009 007 558 U

(51) Int. Cl.

| | |
|---|---|
| ***B01F 3/04*** | (2006.01) |
| ***F02M 7/10*** | (2006.01) |
| ***F02M 69/36*** | (2006.01) |
| ***F02D 3/04*** | (2006.01) |
| ***F02M 69/18*** | (2006.01) |
| ***F02M 17/38*** | (2006.01) |
| *F02D 41/14* | (2006.01) |
| *F02D 41/20* | (2006.01) |

(52) U.S. Cl.

CPC ..... *F02M 69/18* (2013.01); *F02M 7/10* (2013.01); *F02M 69/36* (2013.01); *F02D 3/04* (2013.01); *F02M 17/38* (2013.01); *F02D 41/1454* (2013.01); *F02D 2041/2027* (2013.01)

USPC ..... 261/26; 261/36.2; 261/78.1

(58) Field of Classification Search

USPC ..... 261/26, 36.2, 78.1

See application file for complete search history.

(56) References Cited

U.S. PATENT DOCUMENTS

| | | | | |
|---|---|---|---|---|
| 3,360,940 A * | 1/1968 | Rimmer | ..... | 60/237 |
| 3,439,895 A | 4/1969 | Marandi | | |
| 3,545,421 A * | 12/1970 | Strader | ..... | 123/198 R |

FOREIGN PATENT DOCUMENTS

| | | |
|---|---|---|
| DE | 36 03 808 A1 | 8/1986 |
| DE | 102 16 084 A1 | 10/2003 |

(Continued)

OTHER PUBLICATIONS

International Search Report in International Application No. PCT/EP2010/003218; dated Oct. 29, 2010 (with English-language translation).

(Continued)

*Primary Examiner* — Robert A Hopkins
(74) *Attorney, Agent, or Firm* — Oliff PLC

(57) ABSTRACT

In order to create an electrically activated carburettor for petrol engines with an air funnel for sucking in fuel from a fuel line leading into the air funnel which is connected to a fuel chamber and between fuel chamber and orifice in the air funnel a fuel jet for adjusting a fuel quantity that can be sucked in from the fuel chamber because of vacuum in the air funnel that can be flexibly adapted as carburettor more preferably for power implements, which overcomes the above-mentioned disadvantages of the prior art and has a simple, sturdy construction which allows constant long-term behavior, it is proposed that in series connection with the fuel jet at least two Tesla diodes are provided, between which a pumping chamber with a pumping unit is located.

12 Claims, 4 Drawing Sheets

(56) References Cited

FOREIGN PATENT DOCUMENTS

| | | | |
|---|---|---|---|
| DE | 102 42 816 | A1 | 3/2004 |
| EP | 1 353 058 | A2 | 10/2003 |
| EP | 1 353 058 | B1 | 11/2005 |
| GB | 1135431 | | 12/1968 |
| GB | 2 176 838 | A | 1/1987 |
| WO | WO 03/081045 | A1 | 10/2003 |

OTHER PUBLICATIONS

Titus, Jon, Micro Pumps Take the Heat, Design News, Mar. 7, 2005, pp. 1-3.

* cited by examiner

ELECTRICALLY ACTIVATED CARBURETTOR

TECHNICAL AREA

The present invention relates to an electrically activated carburettor for petrol engines with an air funnel for sucking in fuel from a fuel line leading into the air funnel, which fuel line is connected to a fuel chamber and between fuel chamber and orifice in the air funnel comprises a fuel jet for adjusting a fuel quantity that can be sucked in from the fuel chamber because of vacuum in the air funnel.

PRIOR ART

Such a carburettor is known for example from DE 102 16 084 A1.

Conventional carburettors create an air-fuel mixture by sucking-in fuel and mixing with air. The amount of fuel that is supplied to the air funnel is adjusted on the fuel nozzle in the fuel line. Through growing requirements particularly with special small engines, such as combustion engines for chainsaws, which are continuously subject to changes angles to the horizontal and the desire for flexible power adaptation there is the need to quickly and flexibly influence the generation of air-fuel mixtures in petrol engines. In the case of engines for bikes there is for example the objective of a lower pollutant generation through flexible adaptation of the carburettor.

DE 102 16 084 A1 attempts to solve this object in that the fuel jet is provided with a variable flow cross section. For changing the flow cross section, a piezoelectric actuator is proposed. Because of a short travel of such piezoelectric actuators however a translation element is required, which renders the construction of such a carburettor complex. In addition, the use of a translation element leads to a higher inaccuracy and greater susceptibility.

DE 102 42 816 A1 describes an electromagnetic valve, wherein flow channels upon current flow in a coil are fluidically separated from one another through an armature plate. With the armature plate as only moveable part, only minor forces for opening and closing of the valve are necessary.

PRESENTATION OF THE INVENTION

Object, Solution, Advantages

The object of the present invention is to create a flexibly adaptable carburettor for petrol engines, particularly for power implements, which overcomes the abovementioned disadvantages of the prior art and has a simple, sturdy construction which makes possible constant long-turn behaviour.

This object is solved starting out from a carburettor according to claim 1. Advantageous designs and further developments of the invention are stated in the subclaims.

The invention includes the technical teaching that in series connection with the fuel jet at least two Tesla diodes are introduced, between which a chamber (in the following called "pump chamber") with a pump unit is located.

The invention utilizes the characteristic of Tesla diodes of having a higher flow resistance in a direction called "reverse direction" in the following than in a direction opposite to the reverse direction, which in the following is called "forward direction". The ratio of the pressure loss in both directions is expressed with the so-called "diodicity", which is a dimensionless number. Because of this asymmetrical characteristic, such a component, analogously to the diodes in electrical engineering, is also called fluidic diode.

The asymmetry of the flow resistance of a Tesla diode results from a loop-like arrangement of flow channels, wherein in forward direction a liquid flowing through the Tesla diode predominantly flows through straight channels, whereas in reverse direction the flow has to flow through at least one bent channel, as a result of which the flow resistance is increased. In addition to this, in at least one region in which a bent and a straight channel meet, a backup develops which in turn enlarges the flow resistance in the reverse direction. The exact operation of a Tesla diode is known and will not therefore be discussed any further at this point.

If through the pump unit the volume in the pump chamber arranged between the two Tesla diodes is lowered, the pressure therein rises. Viewed from the pump chamber, a first Tesla diode is connected in reverse direction, a second Tesla diode in forward direction. Because of the low flow resistance in the second Tesla diode, fluid from the chamber flows either completely or at least for the greater part through the second Tesla diode.

If the pump unit in a pumping operation moves in the opposite direction so that a vacuum is created in the chamber, fluid is sucked in from the fuel line. Since regarding a flowing into the pump chamber only the first Tesla diode is present in forward direction, fuel flows either completely or at least for the greater part through the first Tesla diode.

Thus, through the arrangement of a pump chamber with a pumping unit, which are arranged between two Tesla diodes arranged in the same flow direction, a simply constructed pumping device is achieved. This acts as control unit which efficiently and flexibly adapts the flow of the fuel in the fuel line from the fuel jet to the orifice in the air funnel. Thus, with the invention, a flexibly adaptable carburettor is achieved, which can quickly react to external influences such as a tilting or pivoting of a power implement or internal influences such as the lambda value in the exhaust gas with a simple construction at the same time.

Since in the Tesla diodes neither mechanically moveable nor electrical components are present, these have an extremely low susceptibility. They do not have any wear parts and therefore retain a constant long-term behaviour without wear. Since there are no moveable parts in the Tesla diodes, they do not have any leakage problems either. If in addition a simply constructed pumping unit is used, the entire control unit and thus the carburettor according to the invention have a high level of robustness and low susceptibility with constant long-term behaviour at the same time. Because of the absence of an opening threshold, a Tesla diode can also be operated in the kHz range without problems.

It is of particular advantage if the Tesla diodes viewed in the flow direction from the fuel jet towards the air funnel are introduced in reverse direction. In this case, the control unit pumps in opposite direction to the fuel flow from the fuel jet to the orifice in the air funnel and thus has the function of a throttling unit. If the control unit fails, more fuel is delivered in the fuel line to the air funnel than during the operation of the control unit, i.e. the air-fuel mixture that is generated in the carburettor will then become richer. For this reason it is advantageous to adjust the fuel jet so that without the control unit an air-fuel mixture that is too rich would be generated in the air funnel. In normal operation of the carburettor according to the invention, the control unit leans out the mixture to the desired mixing ratio. Upon a failure of the control unit, the air-fuel mixture will then be too rich instead of too lean, which does not damage the engine.

However, it can also be advantageous to enrich a lean air-fuel mixture through the control unit. In this case, the two Tesla diodes are arranged in forward direction and thus support the flow from the fuel jet to the orifice in operation.

In a preferred embodiment, the pumping unit is a diaphragm element. This diaphragm element has a diaphragm which forms a part region of an inner wall of the pumping chamber. Through periodic movement of the diaphragm, a volumetric change in the pumping chamber and thus a pressure change in the pumping chamber are periodically generated. The diaphragm is moved for example electromechanically or via a piezoelectric element. Such diaphragm elements are robust elements which have a low susceptibility and a long lifespan. Because of the very low weight of the diaphragm, this can be moved with very high frequencies.

Alternatively, it can be advantageous to employ a pumping unit which has a pumping piston. In this case, the piston assumes the object of periodically reducing or increasing the volume in the pumping chamber.

Advantageously, the pumping unit is activated in a voltage-modulated manner. This has the advantage that digital signals can be employed. The modulation makes possible a stepless adjustment of the pumping unit and thus a stepless control of the fuel flow in the fuel line.

It is of particular advantage if the pumping unit is activated in a pulse width modulated manner. This modulation is particularly easy to handle in order to bring about a stepless adjustment of the pumping unit with a simple control.

In addition, it can be advantageous that the pumping unit is regulated by a control that evaluates measurements from an exhaust gas lambda probe. The generated exhaust gas mixture is analyzed by a sensor and via the control leads to an adjusting correction for the fuel quantity to be fed to the air funnel.

Advantageously, however, a series of other measurements can also be supplied to the control instead or in addition, which activates the pumping unit and thus adjusts the fuel quantity to be supplied to the air funnel.

Preferably, the Tesla diodes with petrol as fuel have a diodicity between 1.1 and 3, more preferably between 1.3 and 2.

The diodicity of the Tesla diodes can be influenced as designed or required through the geometrical design of the Tesla diodes during their manufacture. Thus, curvature radii, angles and cross-section areas of the paths of a Tesla diode are suited to influence the diodicity. The geometrical design of the Tesla diodes is also advantageously suited for specifically adjusting the delivery characteristic of the regulating device. Depending on how rate of delivery, delivery pressure, dependency on the frequency of the pumping unit and similar parameters of the regulating device are desired or required, the Tesla diodes are designed accordingly or corresponding Tesla diodes for the control unit are employed.

It is advantageous if the Tesla diodes are designed so that the Reynolds number in the Tesla diodes is clearly below the critical Reynolds number of 2,300. "Clearly" here is to mean a Reynolds number of below 2,000, more preferably below 1,200, preferentially below 500. This has the advantage that the fuel flows through the Tesla diodes with a laminar flow. This results in a favourable behaviour of the Tesla diodes, wherein "favourable" is to mean a continuous characteristic profile which does not exhibit any sudden changes of the flow resistance of the Tesla diodes as a function of the flow velocity. This supports a stepless control of the fuel flow.

The advantageous Reynolds numbers can be preferably achieved through a small size of the Tesla diodes with an advantageous cross section of the channels in the Tesla diode between 0.05 $mm^2$ and 1 $mm^2$, preferably between 0.1 $mm^2$ and 0.5 $mm^2$.

Advantageously, the chamber and/or the Tesla diodes are designed as depression of a plate. This plate can for example be a metal plate. This has the advantage that the chamber and/or the Tesla diodes can be produced with conventional surface machining methods. These can advantageously be methods such as spark erosion, laser treatment, etching but also milling. Whether a rather delicate machining method such as etching or rather a coarse machining method such as milling is possible, mainly depends on the size of the carburettor.

Particularly advantageous is the manufacture of the Tesla diodes through stamping by means of micro-stamping dies. This method makes possible a precise and yet cost-effective manufacture.

A lid-like termination of the chamber and/or of the Tesla diodes is advantageously formed by a further plate, which closes off the hollow spaces of the chamber and/or of the Tesla diodes from the top.

This construction of two plates has the advantage that a substantial part of the control unit is already present by means of two plates which are simple to produce. Two plates can be very simply integrated in a conventional carburettor housing. Thus, the present invention also has the advantage that existing manufacturing processes for conventional carburettors have to be modified only to a minor degree or existing carburettors can even be retrofitted.

BRIEF DESCRIPTION OF THE DRAWINGS

Further advantageous designs and further developments of the carburettor according to the invention are explained in more detail in the following by means of exemplary embodiments in conjunction with the drawings. There it shows in purely schematic representation.

BEST WAY TO CARRY OUT THE INVENTION

Figure 1:
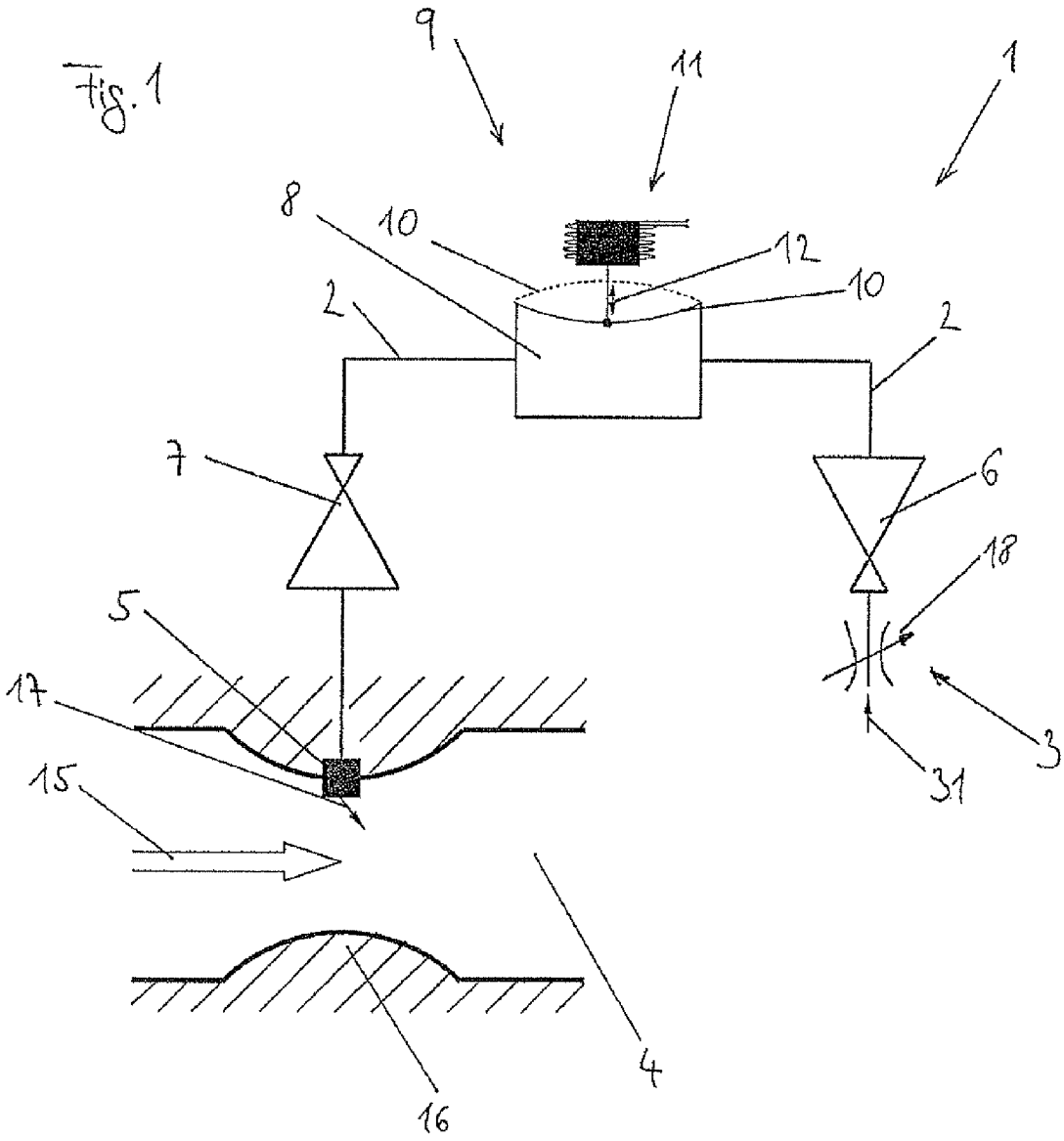
FIG. 1 a circuit diagram of a carburettor according to the invention.

FIG. 1 schematically shows the circuit diagram of a carburettor 1 according to the invention. The carburettor has a fuel line 2, which runs from a fuel chamber (not shown) via a fuel jet 3 to an air funnel 4, where it exits at an orifice 5. In the fuel line 2, a first Tesla diode 6 and a second Tesla diode 7 are introduced. Both Tesla diodes 6, 7 are arranged in reverse direction in this exemplary embodiment, which is shown in FIG. 1 through the corresponding orientation of the circuit symbol. Between the Tesla diodes 6, 7, a chamber 8 called "pumping chamber" in the following is arranged, which via the fuel line 2 is in fluidic connection with the Tesla diodes 6, 7. Operationally connected to the pumping chamber 8 is a diaphragm element as pumping unit, which comprises a diaphragm 10 which can be moved by way of an actuator element 11. The actuator element 11 schematically shown as spring element in FIG. 1 is a piezoelectric element in this exemplary embodiment. Alternatively, the diaphragm 10 can be electromagnetically activated. The Tesla diodes 6, 7, the pumping chamber 8 and the pumping unit 9 together form a control unit 30.

When air flows through the air funnel 4, which is indicated in FIG. 1 by an arrow 15, a vacuum ΔP is formed at a constriction 16 of the air funnel 4 as venturi nozzle, as a result of which fuel located in the fuel line 2 is sucked into the air funnel 4 via the orifice 5, as is schematically shown by the arrow 17. By way of an actuator 18 on the fuel jet 3, the fuel flow (indicated through arrow 31 in FIG. 1) from the control chamber to the orifice 5 can be adjusted. Here, the fuel jet 3 is adjusted so that the air-fuel mixture being created in the air funnel 4, which is supplied to the engine (not shown), is too rich for a normal operation of the engine.

Through a periodic activation of the diaphragm element 9 a pressure and vacuum is periodically created in the pump chamber through an up and down movement (represented by a double arrow 12). The interrupted line constitutes the diaphragm 10 in the presence of a vacuum, the continuous line in the presence of a pressure. The periodic volume change in conjunction with the diodicity of the Tesla diodes 6, 7 results in a pumping action of the control unit 30. This pumping action is opposed to the flow 31 in the fuel line 2, as a result of which the control unit 30 in this exemplary embodiment acts as throttling unit. In this exemplary embodiment the diodicity of both Tesla diodes is 1.5.

The diaphragm element 9 is operated in a pulse width modulated manner, so that subject to the use of a digital activation a change of the pumping action of the diaphragm element 9 is simply and effectively possible. In the simplest case, the vibration frequency of the diaphragm 10 can be changed through changing and applied voltage frequency.

Figure 2:
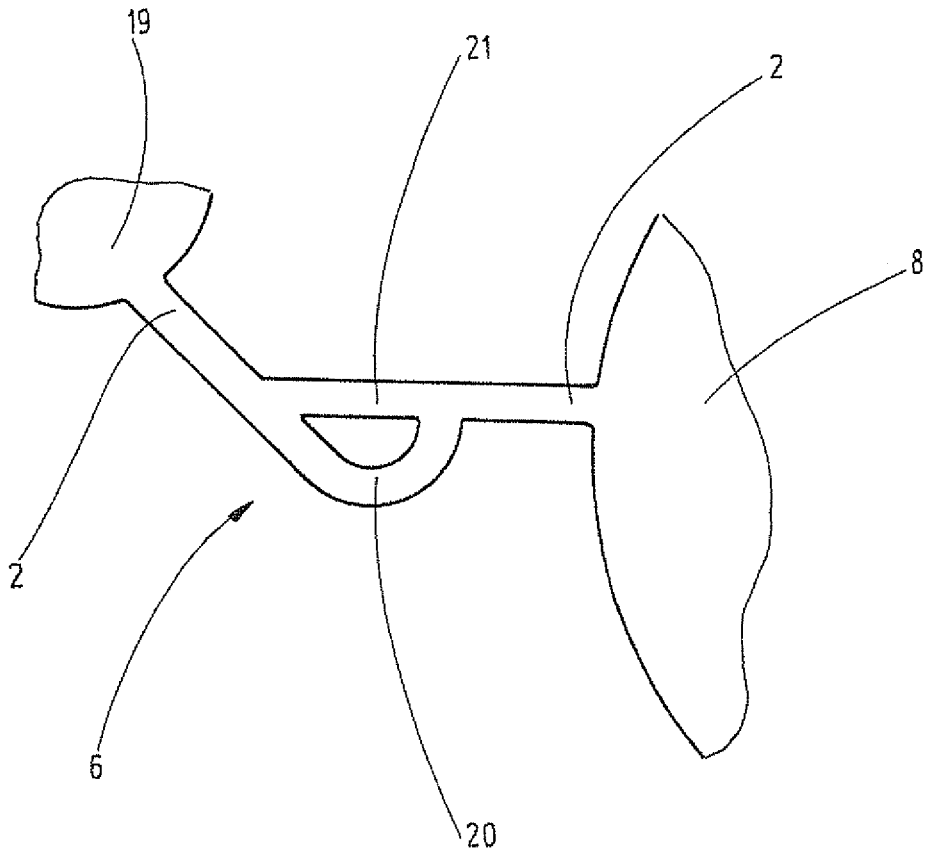
FIG. 2 a macro photo of a Tesla diode.

FIG. 2 shows a representation of the first Tesla diode 6. On the left, a first recess 19 is visible, which is connected to the fuel line which comes from the fuel jet (not shown). To the right, the pumping chamber 8 is visible, which in reverse direction is located behind the Tesla diode 6. The fuel line 2 between the first recess 19 and the Tesla diode 6 and between the Tesla diode 6 and the pumping chamber 8 directly merges into the paths 20, 21 of the Tesla diode in this exemplary embodiment. The curved path 20 and the straight path 21 are designed and lead into each other in such a manner that upon through-flow of the Tesla diode 6 in reverse direction (in the drawing from left to right) a high flow resistance results because of the geometrical conditions and the flow conditions resulting from these.

In this example, first recess 19, pumping chamber 8, fuel line 2 and curved path 20, as well as straight path 21 of the throttling unit 30 are introduced into a metal plate through stamping by means of a micro-stamping die. The width of the paths 20, 21 in this case amounts to approximately 600 μm.

Figure 3:
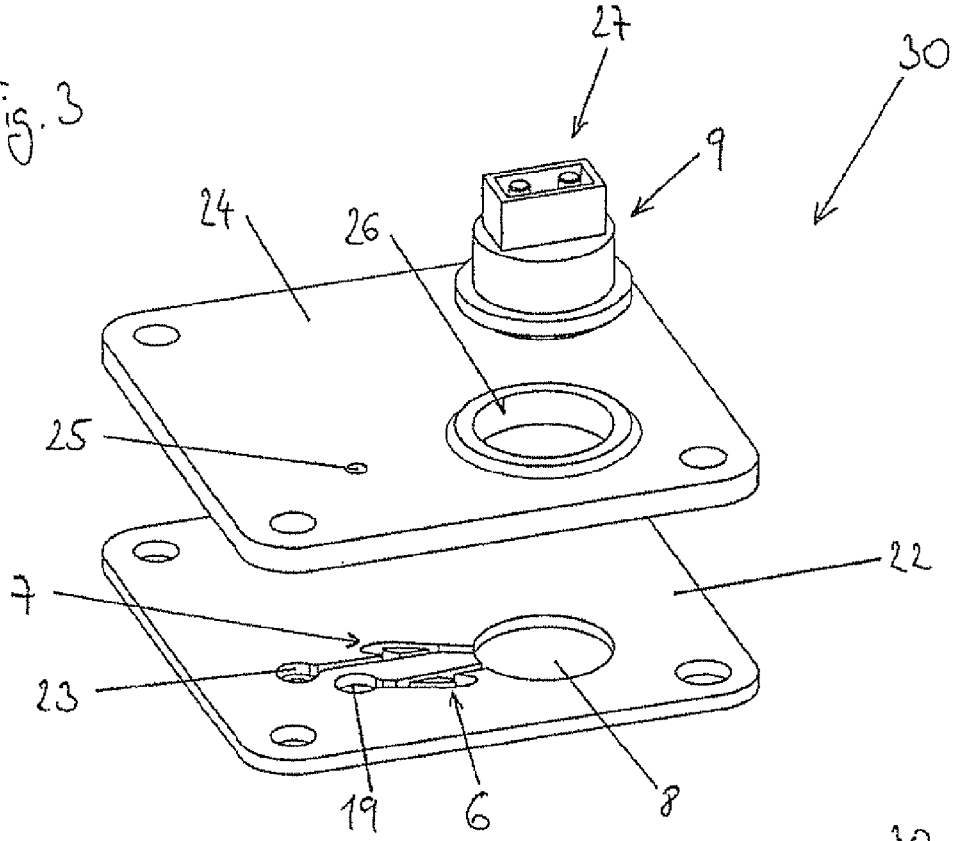
FIG. 3 a perspective exploded view of a control unit of the carburettor according to the invention, FIG. 4 a perspective view of the control unit from FIG. 3 in the assembled state, and FIG. 5 a perspective schematic view of an originally convention carburettor with installed control unit according to FIGS. 3 and 4.
Figure 4:
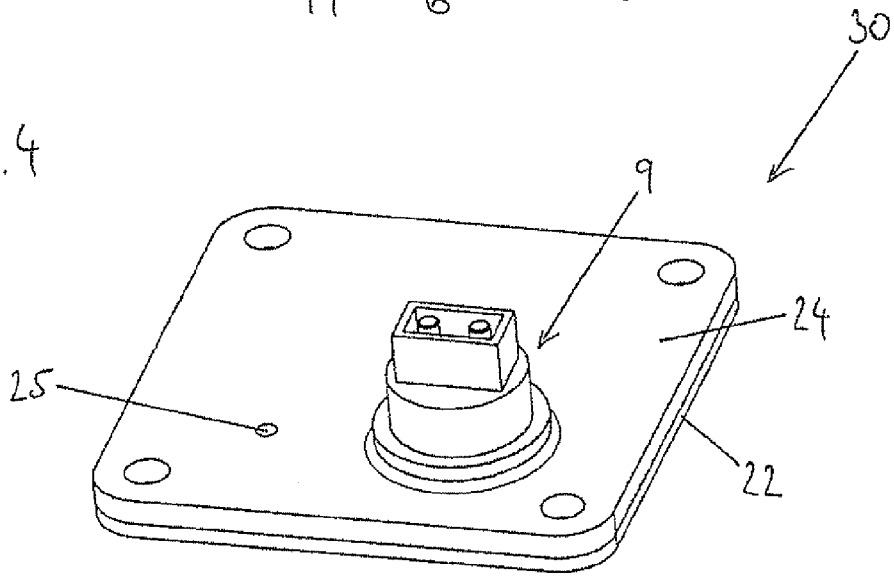

In a second exemplary embodiment (FIG. 3-5) the first recess 19, pumping chamber 8, fuel line 2 and curved as well as first and second Tesla diode 6, 7 of the control unit 30 are introduced into a first metal plate 22 through spark erosion. The diameter of the pumping chamber in this case is approximately 3 mm, the dimensions of the other elements of the control unit 30 with respect to the pump chamber are approximately as represented in FIG. 3. In the first metal plate 22, the first and second Tesla diode 6, 7 are formed substantially parallel to each other. They are interconnected via the pumping chamber 8. Because of this, a U-shaped course is obtained, which results in a space-saving design of the control unit 30. On a free end of the first Tesla diode 6 a first recess 19 is introduced in the metal plate, on a free end of the second Tesla diode 7 a second recess 23 is introduced, which penetrates the first metal plate 22. A second metal plate 22, which forms a lid of the paths 20, 21 of the Tesla diodes 6, 7 and the fuel line 2 can be screwed to the first metal plate 22. In the second metal plate 24, a hole 25 is introduced which forms a connection to the first recess 19 of the first metal plate 22. Thus, the control unit 30 can be connected to a fuel line 2 from the outside. The second metal plate 24 additionally comprises an opening 26, which extends the pumping chamber 8 towards the top. In the opening 26, the diaphragm element 9 is inserted, wherein the diaphragm element 9 in this exemplary embodiment comprises an electrical plug connection 27, via which the diaphragm element 9 can be easily and reversibly connected to a high-frequency source for example with a corresponding mating connector.

The second recess 23 is connected to the orifice 5 in the air funnel 4 (see FIG. 1, accordingly) via the fuel line 2.

Figure 5:
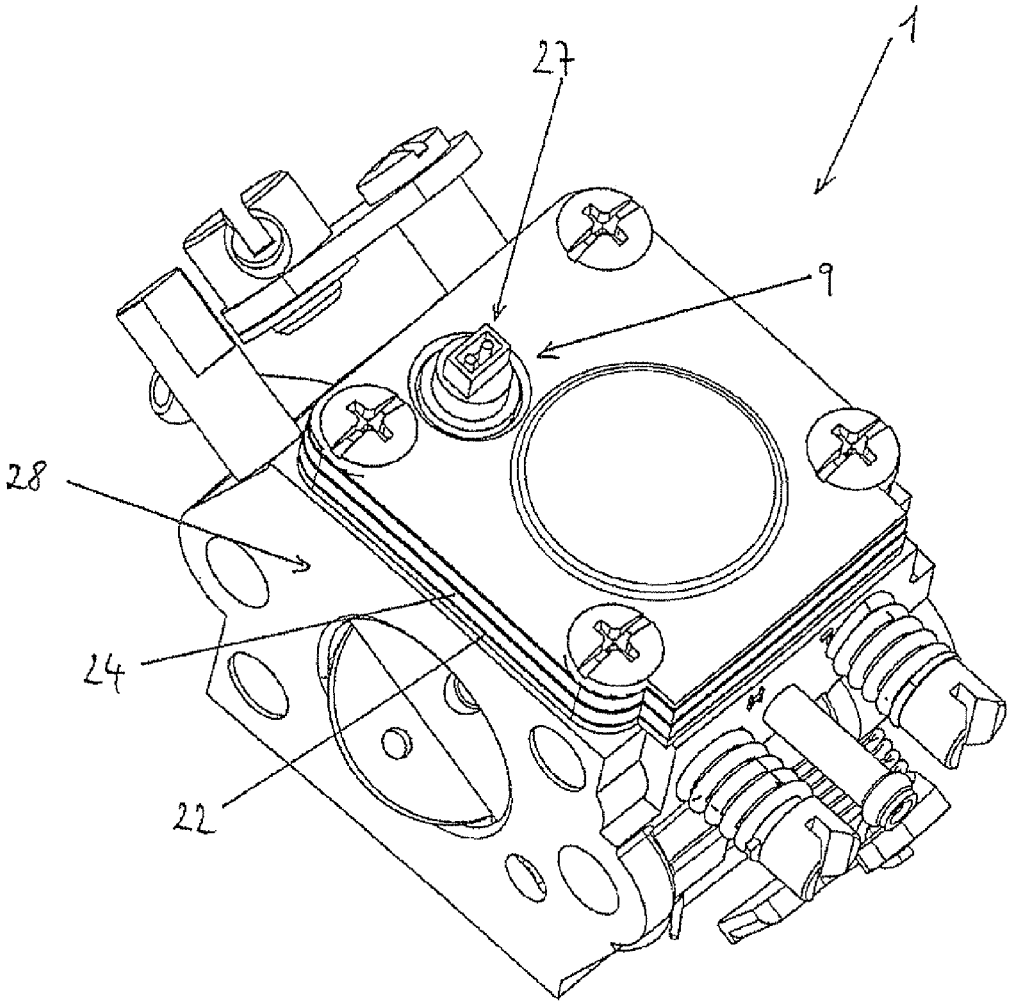

FIG. 5 shows a perspective representation of a third exemplary embodiment, wherein the control unit 30 of the second exemplary embodiment (FIGS. 3 and 4) is integrated in a conventional housing 28 of a carburettor 1. Apart from a minor increase of the thickness of the carburettor 1 through the first metal plate 22 and the second metal plate 24, merely the pumping element 9, which in this exemplary embodiment is a piston element, is noticeable from the outside. Otherwise the same supply lines and connections as with a conventional carburettor are visible, which need not be described in more detail here.

The features disclosed in the above description, the claims and the drawing can be of importance both individually as well as in any combination for the realization of the invention in its different configurations. In particular, the design and arrangement of the Tesla diodes is variable over wide areas. Thus, a plurality of Tesla diodes can be arranged in series or parallel in order to bring about certain effects with regard to desired delivery characteristics of the control unit. To this end, a plurality of curved paths can also be arranged one after the other in a Tesla diode. It can also be advantageous within the scope of the invention to provide a plurality of control units, of which at least one first exercises a throttling function and at least one second one represents and enrichment unit. There, the throttling unit can bring about the leaning out of the air-fuel mixture in normal operation, whereas the enriching unit for example as choke occasionally performs a specific enrichment.

LIST OF REFERENCE NUMBERS

1 Carburettor
2 Fuel line
3 Fuel jet
4 Air funnel
5 Orifice
6 First Tesla diode
7 Second Tesla diode
8 Pumping chamber
9 Pumping unit
10 Diaphragm
11 Actuator element
12 Double arrow (for period diaphragm movement)
15 Arrow (for air flow)
16 Constriction
17 Arrow
18 Actuator
19 First recess
20 Curved path
21 Straight path
22 First plate
23 Second recess
24 Second plate
25 Through hole
26 Opening

27 Electric plug connection
28 Housing
30 Control unit
31 Flow direction

The invention claimed is:

1. An electrically actuated carburettor for petrol engines with an air funnel for sucking in fuel from a fuel line terminating in the air funnel, which is connected to a fuel chamber and between fuel chamber and orifice in the air funnel comprises a fuel jet for adjusting a fuel quantity that can be sucked in from the fuel chamber because of vacuum in the air funnel, wherein in series connection with the fuel jet at least two Tesla diodes are provided, between which a pumping chamber with a pumping unit is located.

2. The carburettor according to claim 1, wherein the Tesla diodes in the course from the fuel jet to the air funnel are introduced in reverse direction, so that a control unit comprising the Tesla diodes, the pumping chamber and the pumping unit has the function of a throttling unit.

3. The carburettor according to claim 1, wherein the pumping unit is a diaphragm element.

4. The carburettor according to claim 1, wherein the pumping unit has a pumping piston.

5. The carburettor according to claim 1, wherein the pumping unit is activated in a voltage modulated manner.

6. The carburettor according to claim 5, wherein the pumping unit is activated in a pulse width modulated manner.

7. The carburettor according to claim 1, wherein the pumping unit is regulated on the basis of measurements.

8. The carburettor according to claim 1, wherein the Tesla diodes with petrol as fuel have a diodicity between 1.1 and 3.

9. The carburettor according to claim 1, wherein the Reynolds number in the Tesla diodes is clearly below the critical Reynolds number of 2,300.

10. The carburettor according to claim 1, wherein the Tesla diodes and the pumping chamber are introduced into at least one of two plates and the other plate serves as lid.

11. The carburettor according to claim 10, wherein the Tesla diodes and the pumping chamber are introduced through surface machining.

12. The carburettor according to claim 1, wherein a carburettor comprises at least one first control unit as throttling unit and at least one further control unit as enrichment unit.

* * * * *